United States Patent [19]

Blackmon et al.

[11] 4,351,147

[45] Sep. 28, 1982

[54] SPUN-LIKE YARN

[75] Inventors: Lawrence E. Blackmon, Foley, Ala.; Darrell A. Kelly, Milton, Fla.; Wayne T. Mowe; Jing-peir Yu, both of Pensacola, Fla.

[73] Assignee: Fiber Industries, Inc., Charlotte, N.C.

[21] Appl. No.: 197,889

[22] Filed: Oct. 17, 1980

Related U.S. Application Data

[63] Continuation-in-part of Ser. No. 101,957, Dec. 10, 1979, abandoned, which is a continuation of Ser. No. 925,073, Jul. 17, 1978, abandoned.

[51] Int. Cl.[3] ..... D02G 3/24; D02G 1/18; D01D 5/22

[52] U.S. Cl. ..... 57/208; 57/245; 57/247; 57/248; 57/905; 264/167; 264/168; 264/171; 264/177 F; 428/370; 428/371; 428/373; 428/397

[58] Field of Search ..... 57/206–208, 57/284, 287, 288, 905, 245–248; 264/167, 168, 171, 176 F, 177 F, 178 F, 210.8; 428/369–371, 373, 374, 397

[56] References Cited

U.S. PATENT DOCUMENTS

| | | | |
|---|---|---|---|
| 2,980,492 | 4/1961 | Jamieson et al. | 57/905 X |
| 3,135,646 | 6/1964 | Hayden | 428/397 X |
| 3,387,327 | 6/1968 | Privott, Jr. et al. | 264/176 F X |
| 3,434,276 | 3/1969 | Fujita et al. | 57/905 X |
| 3,497,585 | 2/1970 | Chapman et al. | 264/171 |
| 3,546,328 | 12/1970 | Lodge et al. | 264/171 |
| 3,547,763 | 12/1970 | Hoffman, Jr. | 264/171 X |
| 3,623,939 | 11/1971 | Ono et al. | 264/168 X |
| 3,920,784 | 11/1975 | Nakagawa et al. | 264/168 |
| 3,991,548 | 11/1976 | Toronyi et al. | 57/208 X |
| 4,103,481 | 8/1978 | Vukoje | 57/208 X |

FOREIGN PATENT DOCUMENTS

| | | | |
|---|---|---|---|
| 42-22339 | 9/1968 | Japan | 264/177 F |
| 891464 | 3/1962 | United Kingdom | 264/178 F |

*Primary Examiner*—John Petrakes

[57] ABSTRACT

A textured continuous filament yarn combining a luxuriant, soft hand with improved moisture wicking for greater comfort in garments. Some filaments have a denier which varies at least 25% (preferably 300–500%), and other filaments have a spiral cross-section.

5 Claims, 7 Drawing Figures

SPUN-LIKE YARN

This application is a continuation-in-part of United States patent application Ser. No. 101,957 filed Dec. 10, 1979, now abandoned, which in turn is a continuation of United States patent application Ser. No. 925,073 filed July 17, 1978 (now abandoned).

The invention relates to a novel textured synthetic yarn combining a soft, luxuriant hand with improved moisture wicking.

Texturing of synthetic yarns has for many years been a significant industry. Texturing, usually by the well known false-twist heat-set technique, improves the bulkiness of the yarn and reduces the harsh, slick hand typical of non-textured synthetic yarns. However, the improvement in hand available in fabrics made from known textured yarns still does not make them comparable to fabrics made from the finer natural fibers.

Conventional textured yarns made from synthetic yarns are also deficient in their moisture wicking properties, and fabrics prepared therefrom are not as comfortable when worn next to the skin as fabrics with superior wicking qualities.

According to the present invention, these and other disadvantages of conventional textured synthetic yarns are overcome by provision of a novel textured synthetic yarn as set forth in detail below.

According to a major aspect of the invention, there is provided a textured yarn having a soft, luxuriant hand and improved wicking comprising a first plurality of filaments comprising alternating S-twisted and Z-twisted helically coiled regions connected by twist reversal regions, each of the first plurality of filaments having a cross-sectional area which varies from small values in thin regions to large values in thick regions along its length, the large values being at least 25% greater than the small values, the thick and thin regions being out of phase from filament to filament along the length of the yarn, and a second plurality of filaments comprising alternating S-twisted and Z-twisted helically coiled regions connected by twist reversal regions, each of the second plurality of filaments having a cross-section comprising a spiral and wherein the outer portion of the spiral lies at the inside of the coils of the helically coiled regions.

According to another aspect of the invention, the large values are between 250–500% of the small values.

According to another aspect of the invention, the filaments are formed from polyester.

According to another aspect of the invention, the filaments have average deniers between 1 and 12.

According to another aspect of the invention, the spiral is open at its inner end.

Other aspects of the invention will in part be set forth below and will in part be obvious from the following detailed description taken in connection with the accompanying drawings, in which FIG. 1 is a vertical sectional view of an exemplary spinneret orifice used in preparing a first species of filament according to the present invention;

The preferred embodiment of yarn according to the invention comprises at least two species of filaments, a first plurality having variable denier and the second plurality having a specified cross-section, as described below.

The invention will be specifically exemplified using polyester polymer, it being understood that certain aspects of the invention are applicable to the class of melt-spinnable polymers generally. "Polyester" as used herein means fiber-forming polymers at least 85% by weight of which is formable by reacting a dihydric alcohol with terephthalic acid. Polyester typically is formed either by direct esterification of ethylene glycol with terephthalic acid, or by ester interchange between ethylene glycol and dimethylterephthalate.

Figure 1:
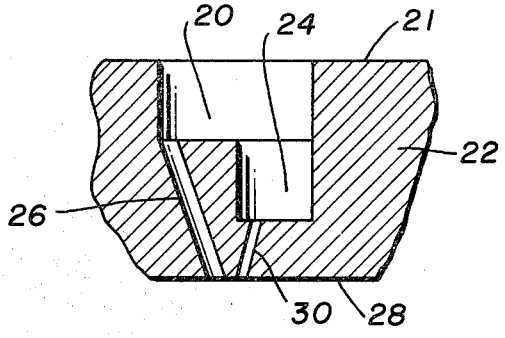
Figure 2:
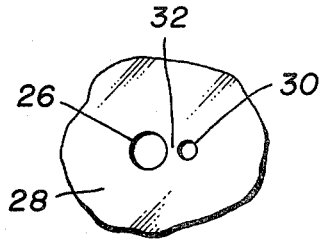
FIG. 2 is a bottom plan view (looking up) of the FIG. 1 spinneret orifice.

FIGS. 1 and 2 illustrate the preferred embodiment of a spinneret design which can be employed for making the first species of filament. The spinneret includes a large counterbore 20 formed in the upper surface 21 of spinneret plate 22. Small counterbore 24 is formed in the bottom of and at one side of large counterbore 20. A large capillary 26 extends from the bottom of large counterbore 20 at the side opposite small counterbore 24, and connects the bottom of large counterbore 20 with the lower surface 28 of plate 22. Small capillary 30 connects the bottom of counterbore 24 with surface 28. Capillaries 26 and 30 are each inclined four degrees from the vertical, and thus have an included angle of eight degrees. Counterbore 20 has a diameter of 0.0625 inch (1.588 mm.), while counterbore 24 has a diameter of 0.031 inch (0.787 mm). Capillary 26 has a diameter of 0.0165 inch (0.419 mm.) and a length of 0.150 inch (3.81 mm.), while capillary 30 has a diameter of 0.0102 inch (0.259 mm.) and a length of 0.0286 inch (0.726 mm.). Land 32 separates capillaries 26 and 30 as they emerge at surface 28, and has a width of 0.0056 inch (0.142 mm.). Plate 22 has a thickness of 0.554 inch (14.07 mm.). Capillaries 26 and 30 together with counterbores 20 and 24 constitute a combined orifice for spinning various novel and useful filaments according to the invention, as will be more particularly described hereinafter.

Figure 3:
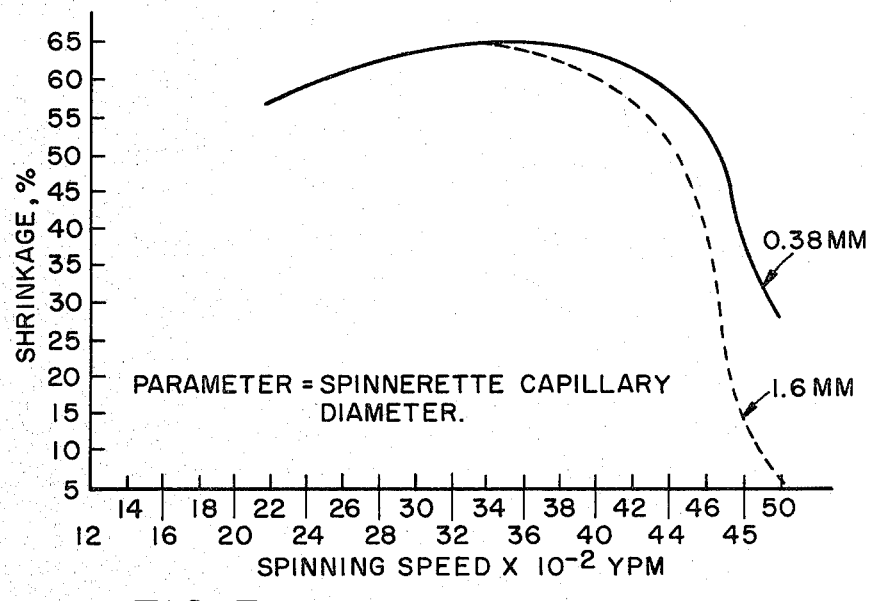
FIG. 3 is a graph of shrinkage versus spinning speed using polyester polymer, useful in explaining certain aspects of the invention.

FIG. 3 is a graph showing how polyester filament shrinkage varies with spinning speed for two illustrative cases of jet stretch. The curve in dotted lines shows that the shrinkage falls from about 65% at 3400 ypm (about 3100 mpm) to about 5% at 5000 ypm (about 4500 mpm) when using spinneret capillaries having diameters of 0.063 inch (1.6 mm.) and when simultaneously spinning 34 such filaments to be false-twist draw-textured to yield a textured yarn having 150 denier. The solid curve shows that the shrinkage drops off at higher speeds when using spinneret capillaries having diameters of 0.015 inch (0.38 mm.) when similarly simultaneously spinning 34 such filaments to be false-twist draw-textured to yield a textured yarn having 150 denier. Using different capillary diameters produces a family of curves between, to the left, and to the right of those illustrated. The curves can also be shifted (for a given capillary diameter) by varying the polymer throughput. In other words, the curves can be shifted by varying the jet stretch, which is the ratio of yarn speed just after solidification to average speed of molten polymer in the capillary. Combining these molten streams into a side-by-side configuration results in a highly crimped filament after the filament is hot drawn and relaxed to develop the crimp as in the prior art. Such combining may be done using a spinneret design similar to that disclosed in FIG. 1, or the spinneret may merge the two streams at or just prior to emergence of the streams from surface 28. In any event, the two streams merge substantially coincident with the face of the spinneret according to this aspect of the invention.

Advantageously, the spinneret is so designed that one of the individual streams has a velocity in its capillary between 2.0 and 7 times (preferably between 3.5 and 5.5 times) the velocity of the other of the streams in its capillary. Further advantages are obtained when the faster of the two streams has a smaller cross-sectional area than the slower of the streams, particularly in degree of crimp and spinning stability.

Further aspects of the invention, applicable to melt-spinnable polymers as a class, are achievable by use of spinnerets wherein the streams intersect outside the spinneret. As a specific example, molten polyester polymer of normal textile molecular weight is metered at a temperature of 290° C. through a spinneret having combined orifices as above specifically disclosed. The polymer throughput is adjusted to produce filaments of 4 average denier per filament at a spinning speed of 3200 meters per minute, the molten streams being conventionally quenched into filaments by transversely directed quenching air.

Figure 5:
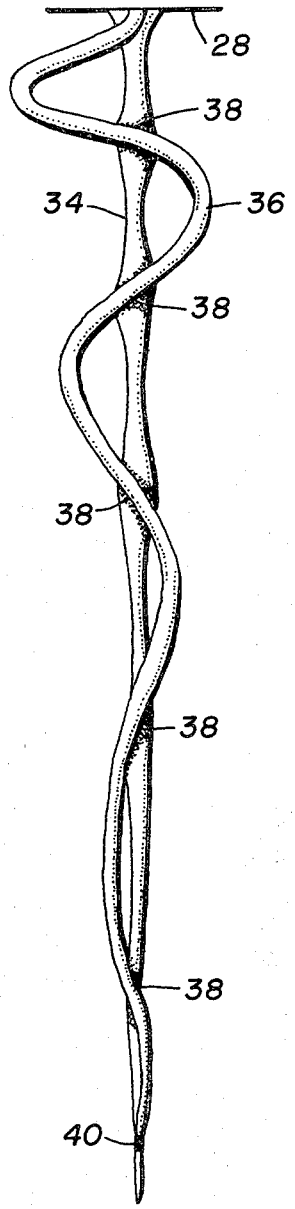
FIG. 5 is a side elevation view of the molten streams issuing from the FIGS. 1 and 2 spinneret orifice, illustrating the unusual action just below the spinneret.

Under these spinning conditions a remarkable phenomenon occurs, as illustrated in FIG. 5. Due to the geometry of the spinneret construction, the polymer flowing through the smaller capillaries 30 has a higher velocity than that flowing through the larger capillaries. The speeds and momenta of the paired streams issuing from each combined orifice and the angle at which the streams converge outside the spinneret are such that the slower streams 34 travel in substantially straight lines after the points at which the paired streams first touch and attach, while each of the smaller and faster of the streams 36 forms sinuous loops back and forth between successive points of attachment 38 with its associated larger streams. This action can be readily observed using a stroboscopic light directed onto the streams immediately below the spinneret face 28. As the molten streams accelerate away from the spinneret, the slower stream attenuates between the points of attachment 38 and the loops of the faster stream become straightened until the faster stream is brought into continuous contact with the slower stream. The slower stream attenuates more between than at the points of first attachment, so that the resulting combined stream has a cross-section which is larger at the points of first attachment than in the regions between these points. The resulting combined stream is then further attenuated somewhat until it is solidified into a filament 40 by the transverse quench air.

Figure 6:
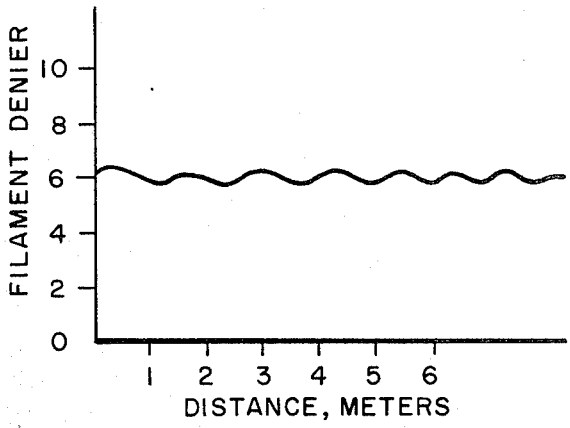
FIG. 6 is a graph qualitatively illustrating how the denier varies in filaments spun from the FIGS. 1 and 2 spinneret orifice.

Each solidified filament 40 has non-round cross-sectional areas which vary repetitively along its length. As illustrated qualitatively in FIG. 6, when using the above spinning conditions, the filament cross-sectional area repetitively varies at a repetition rate of the order of magnitude of about one per meter, although this can be varied by modifying the spinning conditions and the geometry of the spinneret passages.

Figure 7:
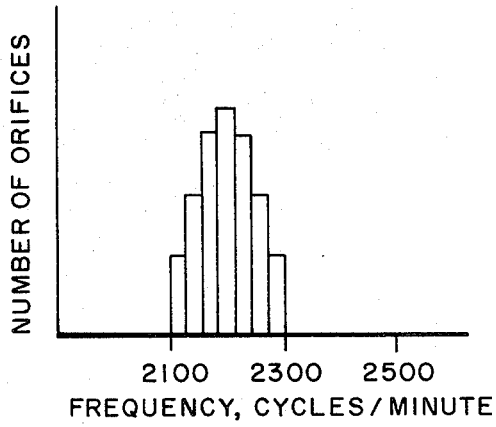
FIG. 7 is a graph showing qualitatively the frequency distribution in an exemplary multiple orifice spinneret of the oscillations depicted in FIG. 5.

Due to minor differences between combined orifices, temperature gradations across the spinneret, and other like deviations from exactly the same treatment for each pair of streams, a multiple orifice spinneret will typically provide somewhat different repetition rates among the several resulting streams and filaments. An example of this is qualitatively shown in FIG. 7, wherein is shown that various orifices produce somewhat different repetition rates as determined by stroboscopic examination of the combined streams just below the spinneret face. In the resulting multifilament yarn, the filaments have non-round cross-sections which vary by more than ±10% along the length of the filaments, the variations in cross-sectional areas being out of phase from filament to filament.

Figure 4:
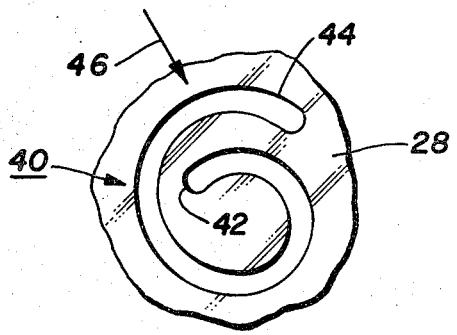
FIG. 4 is a bottom plan view of an exemplary spinneret orifice used in preparing a second species of filament according to the present invention.

FIG. 4 illustrates the preferred spinneret orifice which may be used for spinning the second species of filament. Orifice 40 is formed in spinneret plate 28, extending in a spiral from an inner end 42 to the outer end 44. Preferably the spiral extends over more than 360 degrees, as illustrated. If the clearance between inner end 42 and the nearest intermediate portion of slot 40 is sufficiently small, the molten stream issuing therefrom will bridge the gap between the inner end of the spiral cross-sectioned stream and the nearest intermediate portion of the stream cross-section, forming a filament with a spiral cross-section closed at its inner end. On the other hand, if the noted clearance is slightly larger, the bridging will not occur, and the resulting filament will have a spiral cross-section open at its inner end. Selection of the proper clearance to provide either a closed inner end or an open inner end while using particular spinning and quenching conditions can readily be made by one skilled in the art.

Generally speaking, the filament having a cross-section comprising a spiral closed at its inner end will have a more powerful crimp than one having a cross-section comprising a spiral open at its inner end. The latter will, however, have substantially increased moisture transport and moisture holding capacity as compared to the former, which is itself superior to ordinary round filaments.

The following is an example of the preferred embodiment of the second species of filament.

An orifice similar to that in FIG. 4 is used, the slot being 0.1 mm wide and 4 mm. long along its spiral length. Polyethylene terephthalate polymer of normal textile molecular weight is extruded at a temperature of 290° C. through the orifice and is solidified by transversely directed quenching air into a filament which is wound at 3200 meters per minute. The polymer extrusion rate is selected such that the filament has a denier of about 5. The quenching air has a temperature of 18° C. and 68% relative humidity, and is directed horizontally at the molten stream in a direction parallel to arrow 46 in FIG. 4, the quenching zone being 1.5 meters long. The quenching air has an average velocity of 20 meters per minute and impinges on the relatively thin fin-like outer portion of the spiral cross-section while the remainder of the molten stream is shielded from the quenching air by the outer portion.

The resulting filament has latent crimp and an elongation of 135%. Upon being hot drawn and relaxed at a temperature of 100° C., the yarn develops more than about 12% crimp with alternating S and Z helical sections, the fin-like portion (the outer portion of the helix which was exposed to quenching air) forming the inside of the helical crimp and the remainder of the filament cross-section forming the outside of the helical crimp.

A plurality of each of the first and second species of filaments may be spun through different spinnerets and combined into one threadline at any later state of processing. Preferably, however, the two species of filaments are simultaneously spun through a single spinneret provided with a plurality of orifices of each type.

As a specific example, a first stream of polyethylene terephthalate polymer of normal molecular weight for apparel end uses is metered through 34 orifices of the FIG. 1 type, and a second stream of polymer is metered through 17 orifices of the FIG. 4 type. The polymer temperature prior to extrusion is 290° C., and the molten streams are conventionally quenched into filaments by transverse air. The filaments are converged into a yarn bundle and wound at 3400 yards per minute (about 3100 meters per minute), the polymer extrusion rates being adjusted such that the filaments spun from the FIG. 1 type orifices have a denier of 2 per filament while the filaments spun from the FIG. 4 type orifices have a denier of 4 per filament.

The spun yarn is simultaneously draw-textured on a Zinser 576 using a friction false twister. The draw ratio is 1.353, the texturing heater temperature is 190° C., and the draw roll speed is 500 yards per minute (about 450 meters per minute).

The resulting textured yarn has a very soft, luxuriant hand and moisture transport approaching that of natural fibers such as cotton.

If desired, the draw ratio can be adjusted such that the filaments spun from the FIG. 1 type orifice are broken in their thin regions, increasing the resemblance to a yarn spun from staple fibers.

What is claimed is:

1. A textured yarn having a soft luxuriant hand and improved wicking, comprising:

a. a first plurality of filaments comprising alternating S-twisted and Z-twisted helically coiled regions connected by twist reversal regions, each of said first plurality of filaments having a cross-sectional area which varies from small values in thin regions to large values in thick regions along its length, said large values being at least 25% greater than said small values, said thick and thin regions being out of phase from filament to filament along the length of said yarn, and b. a second plurality of filaments comprising alternating S-twisted and Z-twisted helically coiled regions connected by twist reversal regions, each of said second plurality of filaments having a cross-section comprising a spiral and wherein the outer portion of said spiral lies at the inside of the coils of said helically coiled regions.

2. The yarn defined in claim 1, wherein said large values are between 250–500% of said small values.

3. The yarn defined in claim 1, wherein said filaments are formed from polyester.

4. The yarn defined in claim 1, wherein said filaments have average deniers between 1 and 12.

5. The yarn defined in claim 1, wherein said spiral is open at its inner end.

* * * * *